US012305315B2

(12) United States Patent
Bicker et al.

(10) Patent No.: US 12,305,315 B2
(45) Date of Patent: May 20, 2025

(54) METHOD FOR OPERATING A WASHING MACHINE, AND WASHING MACHINE

(71) Applicant: Miele & Cie. KG, Gütersloh (DE)

(72) Inventors: Rainer Bicker, Verl (DE); Magnus Kortenjann, Telgte (DE)

(73) Assignee: MIELE & CIE. KG, Gütersloh (DE)

( * ) Notice: Subject to any disclaimer, the term of this patent is extended or adjusted under 35 U.S.C. 154(b) by 152 days.

(21) Appl. No.: 17/915,428

(22) PCT Filed: Mar. 22, 2021

(86) PCT No.: PCT/EP2021/057249
§ 371 (c)(1),
(2) Date: Sep. 28, 2022

(87) PCT Pub. No.: WO2021/197892
PCT Pub. Date: Oct. 7, 2021

(65) Prior Publication Data

US 2023/0119831 A1 Apr. 20, 2023

(30) Foreign Application Priority Data

Mar. 30, 2020 (DE) ..... 10202010894.6

(51) Int. Cl.
*D06F 34/16* (2020.01)
*D06F 33/32* (2020.01)
(Continued)

(52) U.S. Cl.
CPC ..... *D06F 34/16* (2020.02); *D06F 33/32* (2020.02); *D06F 34/18* (2020.02); *D06F 34/20* (2020.02);
(Continued)

(58) Field of Classification Search
CPC ..... D06F 33/32
See application file for complete search history.

(56) References Cited

U.S. PATENT DOCUMENTS

2010/0263136 A1* 10/2010 Ashrafzadeh ..... D06F 34/18 68/12.04
2013/0160216 A1 6/2013 Buendia et al.
(Continued)

FOREIGN PATENT DOCUMENTS

EP 2143837 A1 1/2010
EP 2463433 A2 6/2012
(Continued)

*Primary Examiner* — Spencer E. Bell
(74) *Attorney, Agent, or Firm* — Dickinson Wright PLLC

(57) ABSTRACT

A washing machine and method for operating a washing machine having a suds container for holding washing liquid, a non-ribbed drum provided with stamped portions rotatably mounted in the suds container for holding laundry, a motor for driving the drum, and a control device. During rotation of the drum in a subcritical rotational speed range, the method includes sampling a variable related to the drum or the motor over a predetermined period of time to determine time signals of the variable, executing a frequency analysis of the time signal of the variable to determine frequency components of the variable in a predetermined frequency range, summing the frequency components at predetermined frequencies of the predetermined frequency range, and detecting, depending on the sum of the summed up frequency components, whether a loading situation where laundry is sliding in the drum is present.

9 Claims, 2 Drawing Sheets

(51) Int. Cl.

| | |
|---|---|
| ***D06F 34/18*** | (2020.01) |
| ***D06F 34/20*** | (2020.01) |
| ***D06F 37/02*** | (2006.01) |
| ***D06F 37/30*** | (2020.01) |
| ***D06F 103/02*** | (2020.01) |
| ***D06F 103/24*** | (2020.01) |
| ***D06F 103/26*** | (2020.01) |
| ***D06F 103/38*** | (2020.01) |
| ***D06F 103/46*** | (2020.01) |
| ***D06F 105/48*** | (2020.01) |

(52) U.S. Cl.

CPC ..... *D06F 37/02* (2013.01); *D06F 37/304* (2013.01); *D06F 2103/02* (2020.02); *D06F 2103/24* (2020.02); *D06F 2103/26* (2020.02); *D06F 2103/38* (2020.02); *D06F 2103/46* (2020.02); *D06F 2105/48* (2020.02)

(56) References Cited

U.S. PATENT DOCUMENTS

| | | | | |
|---|---|---|---|---|
| 2014/0379142 | A1* | 12/2014 | Borlin | D06F 37/225 700/279 |
| 2020/0149205 | A1* | 5/2020 | Jeoung | D06F 37/04 |

FOREIGN PATENT DOCUMENTS

| | | | |
|---|---|---|---|
| EP | 3412823 | A1 | 12/2018 |
| EP | 3453795 | A1 | 3/2019 |
| WO | 2020046076 | A1 | 3/2020 |

* cited by examiner

METHOD FOR OPERATING A WASHING MACHINE, AND WASHING MACHINE

RELATED APPLICATIONS

The present disclosure claims priority to and the benefit of PCT Application PCT/EP2021/057249, filed on Mar. 22, 2021, which claims priority to and the benefit of German Application 10 2020 108 694.6, filed on Mar. 30, 2020, the entire contents of which are incorporated herein by reference.

TECHNICAL FIELD

The disclosure relates to a method for operating a washing machine and to a washing machine. In particular, the disclosure relates to a method of operating a washing machine and to a washing machine having a non-ribbed drum.

BACKGROUND

Typically, washing machine drums have ribs inside. A rib, which is also referred to as an entraining element, is a part of the drum which, when the drum is moved, also causes the laundry inside the drum to execute a motion, i.e. it entrains the laundry. The rib is usually a plate in the drum on which the laundry located in the drum hangs up to a specific height during the drum rotation and then falls down again and in this way is swirled around and rearranged. Usually, there are a plurality of ribs in the drum, which are arranged at predetermined distances from one another. The ribs are substantial for the laundry to be rearranged while executing a washing program. However, the ribs are additional components that add cost. Therefore, a non-ribbed drum would be desirable.

In the development of a washing machine having a non-ribbed drum, however, we have discovered that there are laundry loads that do not lie in contact with the drum casing, but instead slide in the drum due to the lack of ribs. This behaviour is particularly problematic when the sliding laundry has a mass of 1 kg or more and is caused to lie in contact with the drum casing by a disturbance in the sliding movement, e.g. by the drum base, by the glass door of the washing machine, or by other items of laundry inside the drum. This suddenly creates an imbalanced mass which, due to its size, can cause the drum unit to hit a housing of the washing machine and can also cause the entire washing machine to move. In extreme cases, this can destroy the washing machine. In addition, sliding is problematic for delicate items of laundry. The longer an item of laundry slides on the drum casing, the greater the risk that the textile will be damaged due to friction between the textile and the drum casing.

SUMMARY

The disclosure therefore addresses the problem of providing a method for operating a washing machine and of providing a washing machine having a non-ribbed drum in which the situation where laundry is sliding in the drum during the drum rotation can be detected, in particular in the subcritical rotational speed range.

According to the disclosure, this problem is solved by a method having the features of claim 1 and by a washing machine having the features of claim 9. Advantageous embodiments and developments of the disclosure can be found in the subsequent sub-claims.

The advantages that can be achieved with the disclosure are that it offers an important prerequisite for the reliable operation of a washing machine having a non-ribbed drum. It protects the washing machine from destruction by detecting imbalances caused by sliding laundry and thus also protects a user of the washing machine from getting hurt and protects the laundry washed in the washing machine from being damaged. The method therefore makes it possible to protect the washing machine and the laundry from damage. As a result of a detected loading situation where laundry is sliding in the drum, a predetermined action that is stored in the washing machine can be executed in order to prevent or at least reduce damage.

The disclosure relates to a method for operating a washing machine having a suds container for holding washing liquid, a non-ribbed drum provided with stamped portions, rotatably mounted in the suds container for holding laundry, a motor for driving the drum, and a control device, said method, during rotation of the drum in a subcritical rotational speed range, comprising the following steps:

- sampling a variable related to the drum or the motor over a predetermined period of time to determine time signals of the variable;
- executing a frequency analysis of the time signal of the variable to determine frequency components of the variable in a predetermined frequency range;
- summing the frequency components at predetermined frequencies of the predetermined frequency range; and
- detecting, depending on the sum of the summed up frequency components, whether a loading situation where laundry is sliding in the drum is present.

The disclosure is based on the basic idea that, when the laundry slides over a stamped portion, the drum experiences a force impulse, albeit a possibly small one. The drum is braked. This braking is compensated for by the control device with a motor control in such a way that the torque of the motor increases for a short time. This oscillation of the motor torque is repeated every time the laundry slides over a stamped portion. Therefore, by sampling the variable relating to the drum or the motor and evaluating it by means of frequency analysis, a loading situation where laundry is sliding in the drum can be detected.

A non-ribbed drum is a drum that does not have a rib or entraining element inside it. However, it has elevations and/or depressions other than stamped portions or impressions, which do not have the shape of the plate-shaped rib or entraining element.

In order for a loading situation where laundry is sliding in the drum to be present, it is not necessary for the entire laundry to slide in the drum; rather, it is sufficient if some of the laundry slides in the drum. A loading situation where laundry is not sliding is present when all of the laundry is in contact with the drum casing.

The sampling preferably takes place at a predetermined frequency. The predetermined frequency for sampling is preferably high and is, for example, 100 Hz.

In a preferred embodiment, the physical variable relating to the drum or the motor is a torque of the motor or a variable correlating with the torque of the motor. Alternatively, the physical variable relating to the drum or the motor is preferably an actual rotational speed of the drum or a variable that correlates with the actual rotational speed. More preferably, the variable is the torque of the motor or the actual rotational speed of the drum. More preferably, the variable is torque.

In a preferred embodiment, a loading situation where laundry is sliding in the drum is detected when the sum of the added frequency components is greater than a predetermined limit value. The predetermined limit value is preferably stored in the washing machine. The method therefore preferably also comprises comparing the sum of the summed frequency components with the predetermined limit value.

A plurality of limit values can also be stored in the washing machine, which depend, for example, on the rotational speed of the drum at which the variable is sampled over the predetermined period of time and/or depend on the load amount. The larger the load amount, the greater the problems described above where laundry is sliding. Furthermore, a plurality of limit values can also be stored in the washing machine, which depend, for example, on the textile type to be subjected to the washing program, which is defined by the user adjusting the washing program when the washing program is started. Sliding is much more problematic for delicate laundry such as silk or wool than for less delicate laundry such as cotton laundry because the risk of damage due to friction between the textile and the drum casing is greater for delicate laundry.

If a loading situation where laundry is sliding in the drum is detected, a predetermined action is preferably also executed. It is preferably decided that the predetermined action is executed if the sum of the summed frequency components is greater than the predetermined limit value.

In a preferred embodiment, the predetermined action is redistributing the laundry in the drum or continuing to rotate the drum at a rotational speed of the drum that is below the subcritical rotational speed range.

Redistribution of the laundry can be implemented by stopping the rotation of the drum. In a preferred embodiment, the rotation of the drum is stopped if a loading situation where laundry is rolling in the drum is detected. Preferably, when the rotation of the drum is stopped, the rotational speed of the drum is set to 0 rpm, and after setting the rotation speed of the drum to 0 rpm, the drum can then be rotated again, for example by rotating the drum in one direction, which is opposite to the direction in which the drum was rotated before the rotation stopped. For example, after the rotation of the drum has stopped, the rotational speed is subsequently increased to a rotational speed below the contact rotational speed at which the centrifugal force acting on the laundry is greater than the force of gravity. In this way, a further spinning step can be avoided.

Redistribution of the laundry can alternatively be implemented by continuing to rotate the drum with a rocking process. In another preferred embodiment, the rotation of the drum is continued in a rocking process if a loading situation where laundry is rolling in the drum is detected. When the rotation of the drum is continued in a rocking process, the drum is driven in a right-left motion by means of the motor so as to cause a rocking motion of the laundry at a predetermined rocking frequency. As a result, the drum does not complete a complete revolution, but rather rocks from left to right and vice versa. In this case, the rocking process is carried out such that a redistribution of the laundry is implemented, for example, by creating a fall of laundry in the drum.

Alternatively, the predetermined action may be to continue rotating the drum at a rotational speed of the drum that is below the subcritical rotational speed range. This prevents the laundry from being spun. As a result, a deflection of the drum unit can be at least reduced in comparison to spinning.

If the sum of the added frequency components is less than or equal to the predetermined limit value, a loading situation where laundry is not sliding in the drum is preferably detected. If a loading situation where laundry is not sliding in the drum is detected, the washing program is preferably continued without executing the predetermined action.

The drum, preferably the drum casing, has stamped portions or impressions other than a rib. The stamped portions or impressions are preferably each designed as a depression and/or an elevation. The drum, in particular the drum casing, preferably has honeycombs or circles, each of which is designed as an elevation or depression. The number of stamped portions is preferably between 2 and 20, preferably between 4 and 10.

In a preferred embodiment, the predetermined period of time comprises an integral number of revolutions of the drum. Preferably, the predetermined period of time comprises one complete revolution of the drum or an integer multiple of the complete revolution of the drum. More preferably, the predetermined period of time is an integer multiple of the complete revolution. This allows errors to be minimised. Preferably, the integer multiple is in the range of 2 to 20, more preferably 3 to 10. For example, if the rotational speed of the drum is 120 rpm, which corresponds to two complete revolutions of the drum per second, then the predetermined period of time may be, for example, 3 seconds, such that it comprises six complete revolutions of the drum.

However, the method can also be carried out at any rotational speed, wherein the predetermined period of time is adapted accordingly and is stored accordingly in the washing machine. The longer an item of laundry slides on the drum casing, the greater the risk that the textile will be damaged due to the friction between the textile and the drum casing. The predetermined period of time is therefore preferably in the period of a few seconds. Preferably, the predetermined period of time is in the range of 1 to 15 seconds. More preferably, the predetermined period of time is in the range of 2 to 10 seconds. More preferably, the predetermined period of time is in the range of 3 to 5 seconds.

Preferably, the predetermined frequencies are harmonic. If all frequency components in the harmonic frequencies are added or summed up, which depend on the rotational speed of the drum at which the drum is rotated during sampling and on the number of stamped portions in the drum casing, then the sum is determined, which can be used to detect a loading situation where laundry is sliding in the drum.

The rotational speed at which the drum is to be rotated during the method is in the subcritical range. The target rotational speed is preferably greater than a contact rotational speed at which the laundry should be in contact with the drum casing. At a target rotational speed of 70 rpm, the laundry lies usually in contact with the drum casing. The subcritical rotational speed range is therefore preferably a range with target rotational speeds of equal to or greater than 70 rpm. The subcritical rotational speed range is more preferably in the range of from 70 to 149 rpm. More preferably, the target rotational speed of the drum at which the drum is to be rotated in the method is in the range of from 120 to 149 rpm. In this range, the problem of sliding laundry occurs particularly frequently. The target rotational speed is preferably kept constant while sampling the variable.

The actual rotational speed of the drum can deviate from the target rotational speed depending on the imbalance that occurs. At actual rotational speeds from approx. 70 rpm, the laundry usually lies in contact with the drum casing. Since in practice it is never completely evenly distributed on the drum casing, an imbalance of varying magnitude is formed depending on the distribution of the laundry. This imbalance causes a sinusoidal actual rotational speed signal that fluctuates slightly around the value of a target rotational speed. If the imbalanced mass has to be raised, the rotational speed of rotation of the drum slows down. The motor control compensates for this by increasing the motor torque. If the drum has rotated by half a revolution, the imbalance supports the rotational motion with its mass. The drum rotates slightly faster than the specified target rotational speed. Torque must be reduced to reduce actual rotational speed. This oscillation of the actual rotational speed occurs once per drum revolution and is very even, since the physical variables that determine it, such as imbalanced mass, lever arm, and drum rotational speed, do not change. Just like the rotational speed of the drum, the torque required to drive the drum also has a uniform sinusoidal curve. In a preferred embodiment, the torque of the motor is increased when an actual rotational speed of the drum is less than a target rotational speed of the drum and decreased when the actual rotational speed of the drum is greater than the target rotational speed of the drum.

The frequency analysis is preferably based on a Fourier transform, more preferably an FFT (Fast Fourier Transform). The FFT offers an efficient calculation method.

The disclosure also relates to a washing machine having a suds container for holding washing liquid, a non-ribbed drum which is rotatably mounted in the suds container for holding laundry, a motor for driving the drum, and a control device that is designed and set up to execute a method according to any of the preceding claims.

Embodiments and advantages described for the method apply correspondingly to the washing machine and vice versa.

The washing machine can be a front loader or a top loader. The term "washing machine" also comprises a combination device such as a washer-dryer. The drum is preferably mounted in the suds container so that it can rotate horizontally.

The control device can be designed in one or more parts. In addition to regulating the rotational speed of the motor for driving the drum, it has other open or closed control means that are required to execute the washing program.

BRIEF DESCRIPTION OF THE DRAWINGS

An embodiment of the disclosure is shown in the drawings in a purely schematic manner and will be described in more detail below. In the drawings.

DETAILED DESCRIPTION OF THE DRAWINGS

Figure 1:
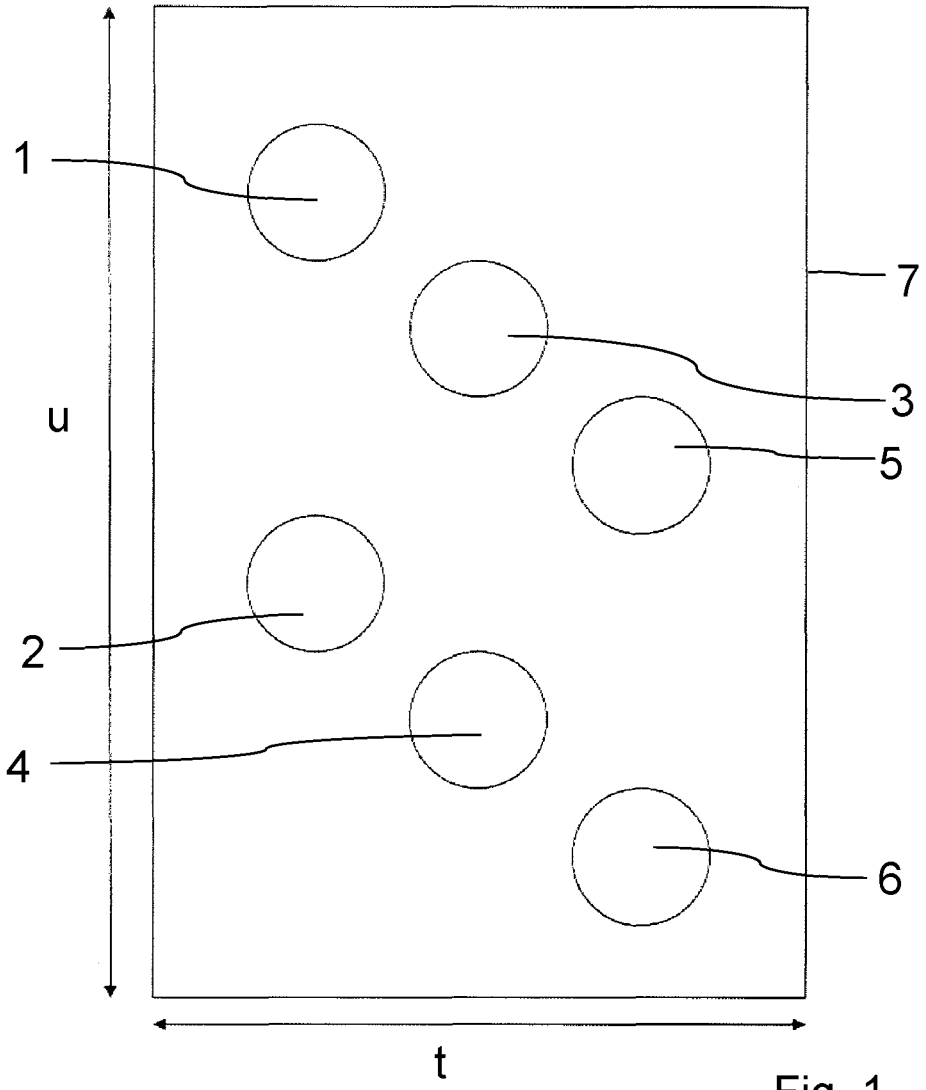
FIG. 1 shows a development of a drum of a washing machine according to the disclosure.

FIG. 1 shows a development of a drum of a washing machine according to the disclosure. FIG. 1 shows in particular the development of the drum 1 with the depth t and the circumference u. The drum 1 has a plurality of—for example six—stamped portions 1, 2, 3, 4, 5, 6. The stamped portions 1, 2, 3, 4, 5, 6 can each be designed as an elevation or depression in the drum 1.

The washing machine (not shown) having a suds container (not shown) for holding washing liquid (not shown), the non-ribbed drum 7 which is provided with stamped portions 1-6, shown in development in FIG. 1 and which is rotatably mounted in the suds container for holding laundry (not shown), a motor (not shown) for driving the drum 7, and a control device (not shown), is designed to execute the method according to the disclosure, said method, during rotation of the drum 7 in a subcritical rotational speed range, comprising the following steps:

- sampling a variable related to the drum 7 or the motor over a predetermined period of time to determine time signals of the variable;
- executing a frequency analysis of the time signal of the variable to determine frequency components of the variable in a predetermined frequency range;
- summing the frequency components at predetermined frequencies of the predetermined frequency range;
- detecting, depending on the sum of the summed up frequency components, whether a loading situation where laundry is sliding in the drum is present.

The control device has a control of the motor that drives the drum 7.

If the drum 7 having the surface structure shown in FIG. 1 is used in the method, a subsequent signal evaluation of the motor torque is executed, for example, in order to be able to conclude that the laundry is sliding.

A distinction is made in this case between three cases of how the sliding laundry can arrange itself in the drum 7. In a first case, the sliding laundry covers stamped portions 1 and 2; in a second case, stamped portions 1, 2, 3, and 4; and in a third case, all stamped portions 1-6. The preferred mode of operation of the drum 7, in order to detect sliding laundry, is a constant rotational speed above the contact rotational speed of approximately 70 rpm, for example 120 rpm. If there is no sliding laundry, i.e. the entire laundry is in contact with the drum casing, there is usually a fixed imbalance due to the uneven distribution of the laundry, the magnitude of which depends arbitrarily on the laundry distribution. This fixed imbalance produces a variation in motor torque with a rotational frequency of the drum, since the motor torque increases once per drum revolution to increase the fixed imbalance and decreases once when the fixed imbalance decreases again after 180° rotation.

If laundry slides over a stamped portion 1-6, the drum 7 experiences a relatively small force impulse. The drum 7 is braked. This braking is compensated for by the motor control in such a way that the motor torque briefly increases. This oscillation of the motor torque is repeated with each sliding of the laundry over a stamped portion 1-6. In the first case described above, the laundry slides twice per drum revolution, four times in the second case, and six times in the third case per drum revolution over the stamped portions 1-6 and generates an increase in the motor torque. This sliding can be recognized or detected by a frequency analysis, for example by Fast Fourier Transform (FFT) of the time signal of the motor torque, according to the following FIGS. 2 and 3, which are explained in more detail below.

Figure 3:
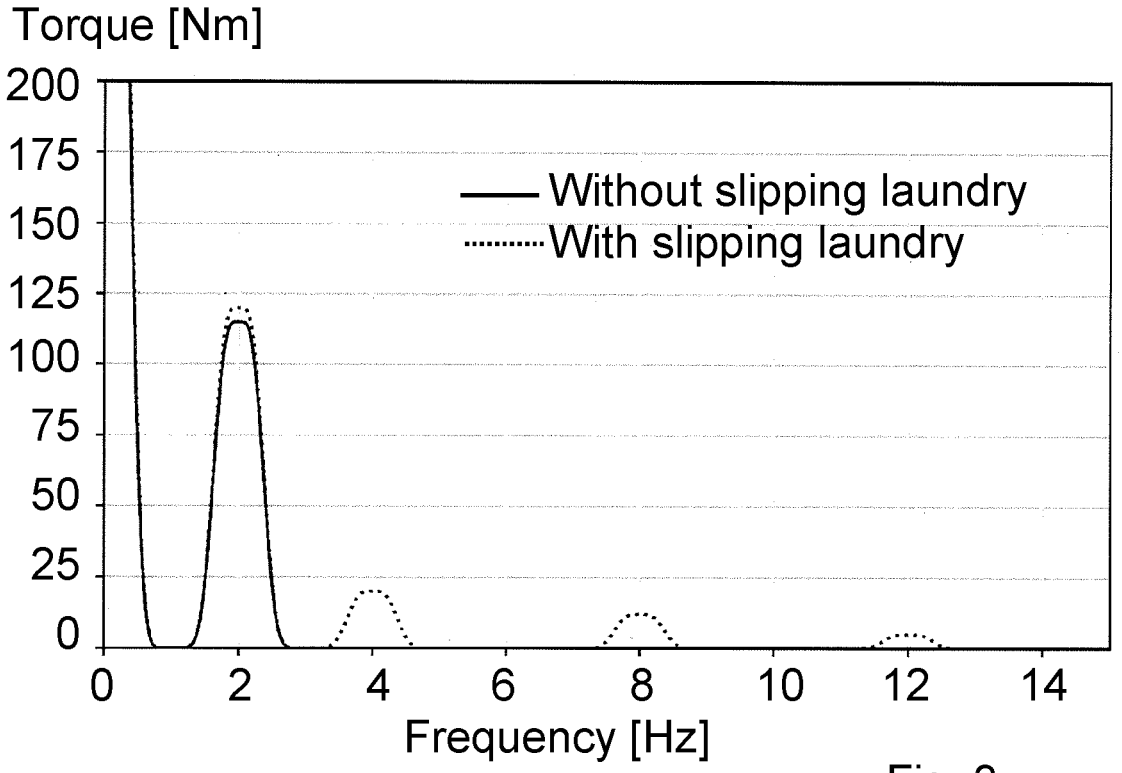
FIG. 3 shows the torque of the motor shown in FIG. 2 as a function of the frequency sampled over the predetermined period of time.

If all frequency components at the harmonic frequencies, as shown for example in FIG. 3, are summed up, which depend on the rotational speed of the drum and the number of stamped portions in the drum surface and the overlapping of the sliding laundry with the stamped portions, a sum is obtained with the help of which the situation where laundry is sliding in the drum is deduced, i.e. it becomes detectable. The first, second, and third cases do not have to be explicitly differentiated, since all cases are always taken into account in the cumulative value. A predetermined limit value for this variable can be stored in the washing machine, so that, if the total is greater than the predetermined limit value, sliding laundry is inferred and a loading situation where laundry is sliding in the drum is detected. This finding can in turn be used during the execution of a washing program in the washing process to decide that a predetermined action is to be executed in order to protect the laundry from wear and/or the washing machine from damage. This predetermined action can consist, for example, in redistributing the laundry or continuing the washing process without spinning.

Figure 2:
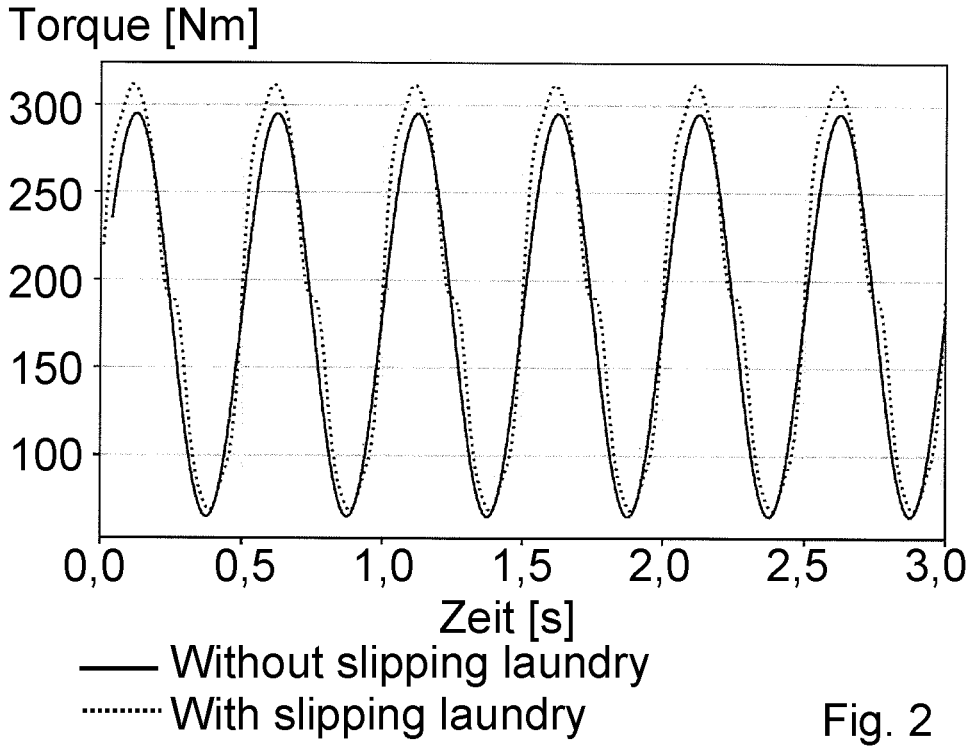
FIG. 2 shows a partial curve of a torque in a time sequence.

FIG. 2 shows a partial curve of a torque in a time sequence. The method according to the disclosure is executed with the washing machine of the drum shown in FIG. 1. FIG. 2 shows the time signal curve of the torque at a drum rotational speed of 120 rpm (2 Hz). The predetermined period of time is 3 seconds during which the drum completes six revolutions at two revolutions per second. The sampling is 100 Hz only as an example.

In the case of the solid line, the laundry lies completely in contact with the drum casing, so that a loading situation where laundry is not sliding in the drum is present, and a fixed imbalance has developed. This fixed imbalance causes the control of the motor per drum revolution to increase the torque relative to an average value, when increasing the fixed imbalance causes a braking of the actual rotational speed, and to decrease it relative to a mean value, when decreasing the fixed imbalance causes an acceleration of the actual rotational speed.

This fixed imbalance causes a sinusoidal actual rotational speed signal that fluctuates slightly around the value of a target rotational speed. If the imbalanced mass has to be raised, the rotational speed of rotation of the drum slows down. The motor control compensates for this by increasing the motor torque. If the drum has rotated by half a revolution, the fixed imbalance supports the rotational motion with its mass. The drum rotates slightly faster than the specified target rotational speed. Torque must be reduced to reduce actual rotational speed. This oscillation of the actual rotational speed occurs once per drum revolution and is very even, since the physical variables that determine it, such as fixed imbalance mass, lever arm, and drum rotational speed, do not change. Just like the rotational speed of the drum, the torque required to drive the drum also has a uniform sinusoidal curve in the case of a loading situation with a fixed imbalance and where laundry is not sliding in the drum.

The torque waveform for the drum with fixed imbalance and where laundry is sliding in the drum and does not completely contact the drum casing but rather slides over one or more stamped portions 1-6, as shown by the dashed line, differs from the torque waveform for the loading situation where laundry is not sliding in the drum.

FIG. 2 substantially reproduces the signal curve of the sampled torque over the predetermined period of time. The time signal of the torque determined in FIG. 2 is subjected to a frequency analysis which results in the spectrum shown in FIG. 3.

FIG. 3 shows the torque of the motor shown in FIG. 2 as a function of frequency sampled over the predetermined period of time. The torques sampled over the predetermined period of time shown in FIG. 2 have been subjected to an FFT, resulting in the spectrum shown in FIG. 3. The predetermined frequency range is 0 to 15 Hz.

In the case of a load of laundry that is completely in contact with the drum casing and where there is a fixed imbalance but no sliding laundry has formed, the FFT results in a frequency component at 0 Hz, which corresponds to the DC component of the motor torque. This is the average motor torque needed to overcome friction, such as bearing friction, in the system. The frequency component at 2 Hz is caused by the rotational speed-frequency torque oscillation of the fixed imbalance. In a loading situation where laundry is not sliding in the drum, no higher frequency components exist in the loading situation, or they exist only to a negligible extent. If, on the other hand, the first case described above is present, where sliding laundry slides over the stamped portions 1 and 2, a torque oscillation with two pulses per revolution or, at a rotational speed of 120 rpm, with four pulses per second is caused. In this case, the frequency analysis shows a frequency component in addition to the components at 0 Hz (friction component) and 2 Hz (fixed imbalance component) at 4 Hz and their harmonic multiple frequencies. The second case described above, where sliding laundry slides over stamped portions 1-4, generates further frequency components at 4, 8, and 12 Hz; the third case described above, where sliding laundry slides over stamped portions 1-6, also generates an additional frequency component at 12 Hz.

LIST OF REFERENCE SIGNS t Depth
u Circumference
1-6 One stamped portion each
7 Drum

The invention claimed is:

1. A method for operating a washing machine having a suds container for holding washing liquid, a non-ribbed drum provided with a plurality of stamped portions rotatably mounted in the suds container for holding laundry, a motor for driving the drum, and a control device, said method, during rotation of the drum in a subcritical rotational speed range, comprising the following steps:

sampling a variable related to the drum or the motor over a predetermined period of time to determine time signals of the variable, the variable being a torque of the motor or correlating with the torque of the motor, or an actual rotational speed of the drum or correlating with the actual rotational speed;

executing a frequency analysis of the time signal of the variable to determine frequency components of the variable in a predetermined frequency range;

summing the frequency components at predetermined frequencies of the predetermined frequency range; and detecting, depending on the sum of the summed up frequency components in relation to a quantity and arrangement of the plurality of stamped portions, whether a loading situation where laundry is sliding in the drum is present.

2. The method according to claim 1, wherein a loading situation where laundry is sliding in the drum is detected when the sum of the added frequency components is greater than a predetermined limit value.

3. The method according to claim 1, wherein, if a loading situation where laundry is sliding in the drum is detected, a predetermined action is further executed, wherein the predetermined action is a redistribution of the laundry in the drum or a continuation of the rotation of the drum at a rotational speed of the drum which is below the subcritical rotational speed range.

4. The method according to claim 1, wherein the stamped portions are each designed as a depression and/or an elevation.

5. The method according to claim 1, wherein the predetermined period of time comprises an integer number of revolutions of the drum.

6. The method according to claim 1, wherein the predetermined frequencies are harmonic.

7. The method according to claim 1, wherein the drum is rotated at a constant rotational speed in the subcritical rotational speed range.

8. The method according to claim 1, wherein the frequency analysis is a Fast Fourier Transform.

9. A washing machine having a suds container for holding washing liquid, a non-ribbed drum which is rotatably mounted in the suds container for holding laundry, a motor for driving the drum, and a control device that is designed and configured to execute a method according to claim 1.

* * * * *